US009953824B2

(12) United States Patent
Deprez et al.

(10) Patent No.: US 9,953,824 B2
(45) Date of Patent: Apr. 24, 2018

(54) LAMP COMPRISING A CONDUCTOR EMBEDDED IN THE QUARTZ GLASS ENVELOPE OF THE LAMP

(75) Inventors: Francis Martin Jozef Deprez, Kuringen (BE); Jozef Merx, Vaals (NL)

(73) Assignee: Lumileds LLC, San Jose, CA (US)

( * ) Notice: Subject to any disclaimer, the term of this patent is extended or adjusted under 35 U.S.C. 154(b) by 260 days.

(21) Appl. No.: 12/440,470

(22) PCT Filed: Sep. 7, 2007

(86) PCT No.: PCT/IB2007/053606

§ 371 (c)(1), (2), (4) Date: Oct. 21, 2009

(87) PCT Pub. No.: WO2008/032247

PCT Pub. Date: Mar. 20, 2008

(65) Prior Publication Data

US 2010/0045183 A1 Feb. 25, 2010

(30) Foreign Application Priority Data

Sep. 12, 2006 (EP) ..... 06120522

(51) Int. Cl.
*H01J 61/073* (2006.01)
*H01J 9/32* (2006.01)
*H01J 61/36* (2006.01)

(52) U.S. Cl.
CPC ..... *H01J 61/0732* (2013.01); *H01J 9/323* (2013.01); *H01J 61/36* (2013.01); *H01J 61/366* (2013.01)

(58) Field of Classification Search
CPC ..... H01J 9/323; H01J 61/0732; H01J 61/36; H01J 61/366
USPC ... 313/631, 623–625, 634–636, 493, 318.12, 313/570, 578; 118/50; 445/26, 27
See application file for complete search history.

(56) References Cited

U.S. PATENT DOCUMENTS 3,882,343 A * 5/1975 Speros ..... H01J 61/18 313/633
4,690,840 A * 9/1987 Gauthier ..... H01M 4/134 427/436
5,297,967 A * 3/1994 Baumberger ..... H05K 7/1069 439/66
5,309,001 A * 5/1994 Watanabe ..... H01L 33/385 257/778

(Continued)

FOREIGN PATENT DOCUMENTS

EP 0528428 A1 2/1993
GB 2351603 A 1/2001

(Continued)

OTHER PUBLICATIONS

Final Rejection, Korea Application No. 10-2009-7007493, dated May 29, 2014, 5 pages.

(Continued)

*Primary Examiner* — Elmito Breval

(57) ABSTRACT

A lamp comprising an envelope (1) of quartz glass surrounding the light source of the lamp is described, wherein an electric conductor (8), for example, an electrode rod, is at least partly embedded in the quartz glass material of the envelope (1). At the conductor (8) is provided with protrusions (15) forming a brush-like structure at this surface. The protrusions (15) preferably have an average length of between 10 μm and 35 μm.

15 Claims, 2 Drawing Sheets

(56) References Cited

U.S. PATENT DOCUMENTS

| | | | | |
|---|---|---|---|---|
| 5,397,240 | A * | 3/1995 | Herard | H01R 12/52 439/196 |
| 5,404,078 | A | 4/1995 | Bunk et al. | |
| 5,461,277 | A | 10/1995 | Van Gennip et al. | |
| 5,905,340 | A | 5/1999 | Karlotski et al. | |
| 6,137,228 | A * | 10/2000 | Aizawa et al. | 313/631 |
| 6,414,509 | B1 * | 7/2002 | Bhatt | G01R 31/2886 257/E21.511 |
| 6,452,334 | B1 | 9/2002 | Ohshima et al. | |
| 6,476,555 | B1 * | 11/2002 | Yoshida et al. | 313/623 |
| 6,486,602 | B1 * | 11/2002 | Setzer | G03F 7/70016 313/351 |
| 6,891,332 | B1 | 5/2005 | Irisawa et al. | |
| 2001/0005117 | A1 | 6/2001 | Nishida et al. | |
| 2002/0079842 | A1 * | 6/2002 | Ehrlichmann | H01J 61/0735 313/639 |
| 2003/0042856 | A1 | 3/2003 | Kaneko et al. | |
| 2003/0178940 | A1 * | 9/2003 | Yoshida et al. | 313/634 |
| 2007/0002525 | A1 * | 1/2007 | Yamanoi | B32B 15/016 361/508 |

FOREIGN PATENT DOCUMENTS

| | | | |
|---|---|---|---|
| JP | H05198285 | A | 8/1993 |
| JP | H10106492 | A | 4/1998 |
| JP | 2001006617 | A | 1/2001 |
| JP | 2001015067 | A | 1/2001 |
| JP | 2002373622 | A | 12/2002 |
| JP | 2003-151497 | A | 5/2003 |
| JP | 2003151497 | A | 5/2003 |
| JP | 2005026128 | A | 1/2005 |
| JP | 2006019054 | A | 1/2006 |
| WO | 2006082539 | A2 | 8/2006 |

OTHER PUBLICATIONS

Preliminary Rejection, Korea Application No. 10-2009-7007493, dated Oct. 30, 2013, 7 pages.

PCT/IB2007/053606 filed Sep. 7, 2007, "International Search Report and Written Opinion" dated Feb. 19, 2008, 12 pages.

First Office Action dated Apr. 14, 2010, China Patent Application No. 200780033928.8, 9 pages.

Second Office Action dated Sep. 30, 2010, China Patent Application No. 200780033928.8, 7 pages.

Notice of Reason for Rejection dated May 31, 2012, Japan Patent Application No. 2009-527269, 9 pages.

Final Notice of Reason for Rejection dated Jan. 29, 2013, Japan Patent Application No. 2009-527269, 9 pages.

* cited by examiner

LAMP COMPRISING A CONDUCTOR EMBEDDED IN THE QUARTZ GLASS ENVELOPE OF THE LAMP

FIELD OF THE INVENTION

The invention relates to a lamp comprising an envelope of quartz glass surrounding the light source of the lamp, wherein an electric conductor is at least partly embedded in the quartz glass material of the envelope. The electric conductor may be an electrode rod, but also another electric conducting member that is embedded in the quartz glass material of the envelope of the lamp, such as a rod-shaped part for applying electric power to an incandescent lamp, for example, a high-power halogen lamp for cooking or for industrial heating applications.

BACKGROUND OF THE INVENTION

A lamp of this type is disclosed in US-A-2001/0005117. This publication describes a high-voltage discharge lamp comprising a quartz glass envelope enclosing the discharge space of the lamp. The lamp is provided with two sealed portions, one sealed portion at each of the two ends of the quartz glass envelope. The ends of two electrode rods project into the discharge space and a portion of each electrode rod is embedded in a sealed portion of the envelope in such a way that the two electrode rods are positioned coaxially with respect to each other. The other ends of the two electrode rods are connected to the ends of conductive molybdenum foil members in order to supply electric current to the electrode rods, which molybdenum foil members are also embedded in the sealed portions of the quartz glass envelope of the lamp. The other ends of the molybdenum foil members are connected to lead-out wires which extend outside the quartz glass envelope of the lamp.

The two electrode rods can be positioned coaxially at both ends of the envelope, but also parallel to each other and at some distance from each other, while they are embedded in the same sealed portion of the quartz glass envelope of the lamp. The lamp may be a xenon metal halide lamp or any other electric discharge lamp, in particular a HID-lamp (high-intensity discharge lamp), or any other lamp comprising a quartz glass envelope, such as a halogen lamp. The lamp may be an integral part of a unit comprising a lamp and a reflector.

Such lamps exhibit a difference of the coefficients of expansion of the conductor material and the quartz glass material of the envelope, in which at least a part of the conductor is embedded in the sealed portion of the envelope of the lamp. Such a difference of the coefficients of expansion causes high stress in the materials of the lamp when in use, particularly in the run-up phase, and the high stress may result in early lamp failure due to cracking or explosion of the envelope of the lamp. Several measures are known in order to avoid cracks in the quartz glass as a result of said difference of the coefficients of expansion, such as applying coils around the electrode rods of the lamp, or applying foils wrapped around the electrode rods. A disadvantage of these measures, most of which require additional parts in the lamp, is the relatively high additional costs.

OBJECT AND SUMMARY OF THE INVENTION

It is an object of the invention to provide a lamp wherein an electric conductor is at least partly embedded in the quartz glass material of the envelope of the lamp, thus reducing the risk of cracks in the quartz glass material of the envelope of the lamp, at least at predetermined locations where such a reduction is desired.

In order to achieve this object, at least a portion of the surface of said part of the conductor is provided with protrusions forming a brush-like structure at said surface, i.e. a structure wherein parts of the material of the conductor extend outwardly and form said protrusions. The protrusions may have a much larger length than the average dimension of their cross-section. Said portion of the surface has a bristly or brush-like appearance, with the protrusions arising from the surface of the conductor like the hairs or spikes of a brush. Experience has proved that such a brush-like structure of the surface of the embedded conductor prevents, or at least reduces, the creation of stress and cracks in the surrounding quartz glass material, in particular when the conductor is heated up quickly.

This is based on the following explanation. Although the brush-like structure of the surface of the conductor will be flattened to some degree when it is embedded in the quartz glass material, there will still be some small space between the hairs of the brush in order to accommodate the additional expansion of the material of the conductor when it is heating up. There is direct contact between the material of the conductor and the quartz glass material, so that the conductor can conduct its heat to the quartz glass. Consequently, heating of the conductor will result in simultaneous heating of the surrounding quartz glass, so that the difference of expansion between the conductor and the surrounding quartz glass is decreased.

In a preferred embodiment, the protrusions have an average length of between 10 μm and 35 μm, preferably between 15 μm and 25 μm, and the material density in the brush-like structure is preferably between 20% and 80%, at which the brush-like structure has a mechanical flexibility and deformation potential which is substantially higher than that of a solid structure of the same material.

In a preferred embodiment, said portion of the surface of the conductor is provided with one or more recesses, while said protrusions are located at the edges of said recesses. Such recesses may be pits in the surface of the conductor, but they are preferably one or more grooves in the surface of said portion of the conductor. The surface of the conductor can then be treated in such a way that the material of the conductor is taken out of the recesses and reshaped into the hair-like protrusions of the brush-like structure at the edges of the recesses.

In a preferred embodiment, the brush-like structure at the surface of the conductor extends in one or more zones of less that 25 μm wide, which zones may extend along the edges of said recesses. The zone or zones may be a helical band around the conductor, or may comprise shorter bands at the surface of the conductor, or may be areas having a different shape.

Said portion of the surface of the conductor is preferably treated by means of a laser beam by which material of the conductor is locally detached and forms protrusions at the surface of the conductor. It has been found that by treating the surface of the conductor by means of a pulsating laser beam, the material of the conductor moves away after it has been exposed to the laser, and at least a part of this material forms the protrusions at the surface of the conductor.

In a preferred embodiment, the material of the conductor is tungsten or tungsten alloy or doped tungsten. In another preferred embodiment, the material of the conductor is a metal other than tungsten from the group of refractory metals such as Mo, Ta, Re, In, in a pure, doped or alloyed quality. Such materials, which are often used in lamps, are embedded in the quartz glass material of the lamp envelope, and it has appeared that the brush-like structure in such materials can be made in a simple and fast operation by means of a laser beam.

The conductor is preferably an electrode rod which is partly embedded in the quartz glass material of the envelope, while the lamp is preferably a high-pressure gas discharge lamp, wherein the electrode rod is embedded in the sealed portion of the quartz glass envelope. In such lamps, the electrode rod will be heated up quickly when the lamp is switched on, particularly in the case of a xenon lamp of a vehicle, in which extra power is supplied to the lamp in order to reach a high light intensity within a short time. The temperature of the electrode rod will then rise very fast. In such a lamp, cracks can be avoided by means of the brush-like structure of the surface of the electrode rod, while there is some space for expansion of the electrode rod. This brush-like structure ensures a relatively fast transfer of heat from the electrode rod to the surrounding quartz glass.

The invention also relates to a method of manufacturing a lamp comprising an envelope of quartz glass surrounding the light source of the lamp, wherein an electric conductor is at least partly embedded in the quartz glass material of the envelope, and at least a portion of the surface of said part of the conductor is treated by means of a laser beam by which material of the conductor is locally detached and forms protrusions at the surface of the conductor.

These and other aspects of the invention are apparent from and will be elucidated with reference to the embodiments described hereinafter.

The Figures are diagrammatic representations, showing only parts that are relevant to the invention.

DESCRIPTION OF EMBODIMENTS

Figure 1:
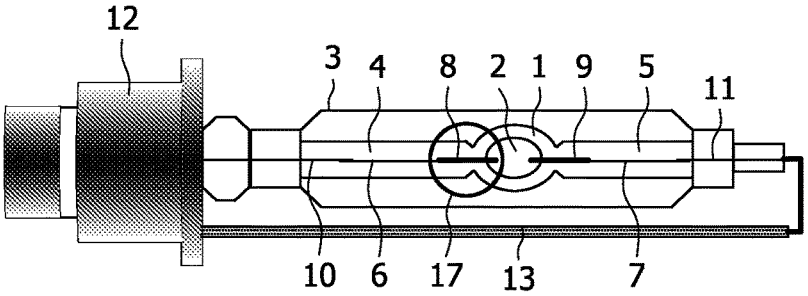
FIG. 1 shows a gas discharge lamp.

FIG. 1 shows a gas discharge lamp having an envelope 1 of quartz glass. The envelope 1 accommodates a gas discharge space 2 which is filled with, for example, mercury, sodium iodide, scandium iodide, xenon and/or other gases. The envelope 1 is surrounded by a transparent outer envelope 3.

The envelope 1 of the lamp is provided with two sealed portions 4, 5 at opposite ends of the envelope 1. Each sealed portion 4, 5 comprises a molybdenum foil member 6, 7 embedded in the quartz glass material of the envelope 1. Each molybdenum foil member 6, 7 is connected to the end of an electrode rod 8, 9, and the other end of each electrode rod 8, 9 projects into the gas discharge space 2. The electrode rods 8, 9 are made of tungsten which may comprise an additive, e.g. $ThO_2$, at least at their surfaces.

Each of the two molybdenum foil members 6, 7 is also connected to lead-out wires 10, 11, respectively, which project outside the quartz glass material of the envelope 1, so that they can be connected to means for supplying electric power. The electric power is supplied to the electrode rods 8, 9 through the molybdenum foil members 6, 7.

The lamp is provided with a cap 12 in order to connect the lamp to a lamp holder. The cap 12 of the lamp is provided with contact elements (not shown) to be connected to corresponding contact members in the lamp holder, so that electric power can be supplied through these contact members from the lamp holder to the lamp. Lead-out wire 10 is connected to one of said contact elements and the other contact element is connected to an electric current guiding rod 13 in order to supply electric power to lead-out wire 11.

Figure 2:
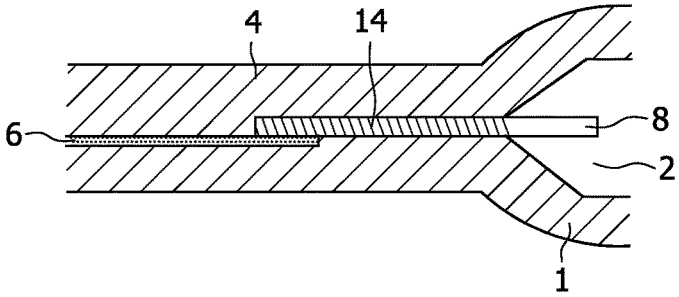
FIG. 2 is a schematic sectional view of a part of the lamp.

FIG. 2 is a schematic sectional, exploded view of a part of the lamp, which part is indicated by circle 17 in FIG. 1. The sealed portion 4 of the quartz glass material of the envelope 1 of the lamp comprises the molybdenum foil member 6 which is connected to the end of electrode rod 8. The other end of electrode rod 8 projects into the gas discharge space 2 of the envelope 1 of the lamp.

A part of the cylindrical electrode rod 8 is embedded in the sealed portion 4 of the quartz glass envelope 1 of the lamp. The surface of this part of the electrode rod 8 is provided with a helical groove 14 which is indicated in FIG. 2 by backward-slashed lines. Protrusions are present along the two edges of the groove 14 are, so that a brush-like structure at the surface of the electrode rod 8 is obtained.

Figure 3:
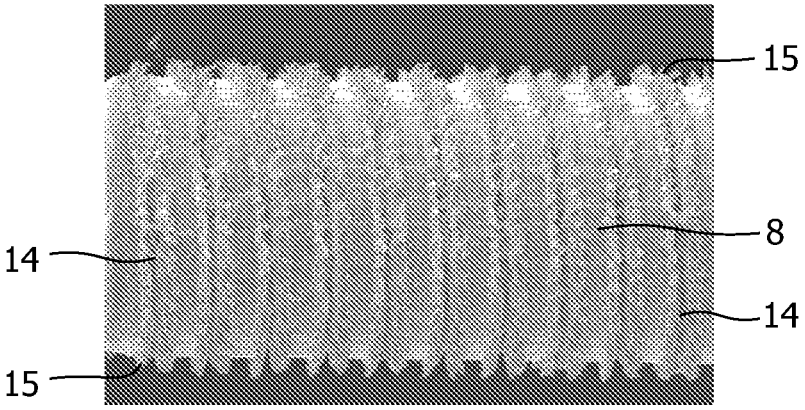
FIG. 3 shows the brush-like surface of the electrode rod.

FIG. 3 represents a portion of the electrode rod 8, wherein the brush-like structure of the surface of the electrode rod 8 is shown. The brush-like structure comprises hair-like protrusions 15 of the material of the electrode rod 8, which protrusions are located at the edge of the helical groove 14 in the cylindrical surface of the electrode rod 8.

The brush-like structure extends in a zone of less than 25 μm wide, aside the groove 14, and is typically 15 μm to 25 μm high, with a dendritic, fibrous and/or conical shape. The protrusions 15 in the zone have an average material density of between 20% and 80%, while the dendritic, fibrous or conical shape has a material density close to 100%. The protrusions 15 have such a height over cross-section ratio that their mechanical flexibility and deformation potential is substantially higher than that of a solid structure of the same dimension.

The brush-like structure shown in FIG. 3 is created by means of an operation with a laser beam directed onto the surface of the electrode rod 8, while the electrode rod 8 is rotating about its axis, so that the helical groove 14 is obtained. In this way, the material of the electrode rod 8 is locally detached and forms the hair-like protrusions 15 of the brush-like structure as shown in FIG. 3.

Figure 4:
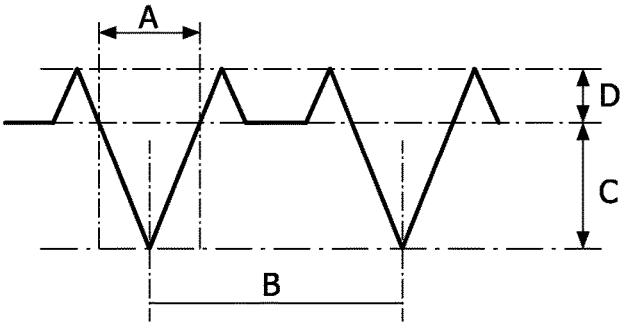
FIG. 4 is a schematic sectional view of the surface of the electrode rod.

FIG. 4 shows diagrammatically the grooves 14 and the protrusions 15. In this example, the grooves 14 have a width A of about 25 μm and a depth C of about 75 μm. The distance B between the grooves 14 is about 100 μm, and the protrusions 15 have a length D (i.e. height) of about 20 μm.

Figure 5:
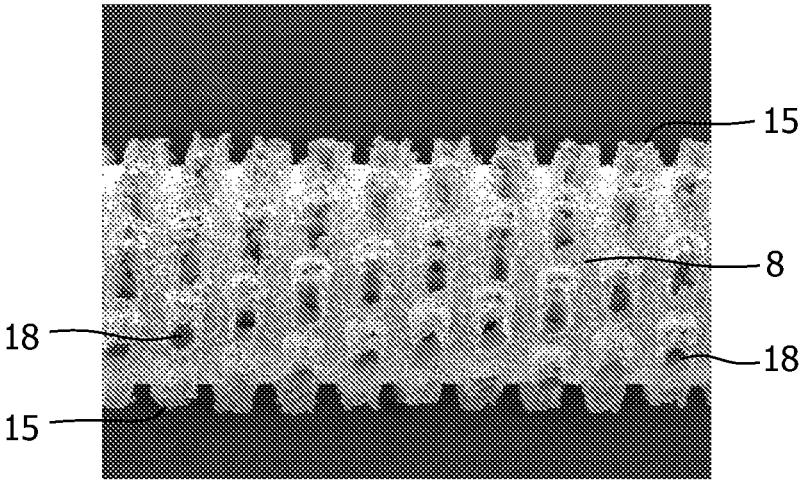
FIG. 5 shows the brush-like surface of another electrode rod.

FIG. 5 shows a cylindrical electrode rod 8 whose surface is treated by means of a pulsating laser beam, so that pits 18 are created in the surface of the electrode rod 8, and the protrusions 15 are located at the edges of the pits 18. The operation is performed by a Q-switched nanosecond YAG laser IR 1064 nm. The pulse length is about 16 ns and the pulse frequency is 33 Hz. The average power is 9.6 W (80% of a 12 W system). The pits have a dimension of about 25 μm. During the operation, the electrode rod 8 rotates at a speed of 1000 rpm. Furthermore, a gas flow (air or argon) is applied in order to allow for traces of oxygen, as oxygen is part of the reaction to obtain the desired brush-like structure.

Due to the brush-like structure of the surface of the electrode rod 8, there will be some space between the electrode rod 8 and the quartz glass material of the sealed portion 4 of the envelope 1 of the lamp, so that the electrode rod 8 can expand a little more than the quartz glass material. Furthermore, due to the brush-like structure, there is a good heat-conducting contact between the material of the electrode rod 8 and the quartz glass material of the sealed portion 4 of the envelope 1 of the lamp. The risk of occurrence of cracks in the quartz glass is thus considerably reduced.

The embodiment of the lamp as described above is only an example of a gas discharge lamp according to the invention; many other embodiments are possible, such as embodiments wherein only some portions of the embedded part of the conductor are provided with the brush-like structure, or wherein portions of the surface of the lead-out wires are provided with the brush-like structure.

The invention claimed is:

1. A lamp, comprising:

an envelope of a quartz glass material defining a discharge space; and an electric conductor that is at least partly embedded in the quartz glass material of the envelope, wherein the electric conductor comprises:

a surface;

one or more recesses in at least a portion of the surface of the electric conductor; and flexible dendritic protrusions on the portion of the surface of the electric conductor at edges of the one or more recesses, the flexible dendritic protrusions forming a brush-like structure on the portion of the surface of the electric conductor, wherein an average material density of the brush-like structure is between 20% and 80% of a solid structure of the same material, thereby providing a mechanical flexibility and deformation potential that is substantially higher than that of the solid structure of the same material.

2. A lamp as claimed in claim 1, wherein the flexible dendritic protrusions have an average length of between 10 μm and 35 μm.

3. A lamp as claimed in claim 1, wherein the brush-like structure on the surface of the electric conductor extends in a zone of less than 25 μm wide.

4. A lamp as claimed in claim 1, wherein the portion of the surface of the electric conductor is treated by a laser beam by which material of the electric conductor is locally detached and forms the flexible dendritic protrusions on the portion of the surface of the electric conductor.

5. A lamp as claimed in claim 1, wherein the material of the electric conductor is tungsten, tungsten alloy, or doped tungsten.

6. A lamp as claimed in claim 1, wherein the material of the electric conductor is a metal other than tungsten from the group of refractory metals such as Mo, Ta, Re, In, in a pure, doped, or alloyed quality.

7. A lamp as claimed in claim 1, wherein the electric conductor is an electrode rod which is partly embedded in the quartz glass material of the envelope.

8. A lamp as claimed in claim 7, wherein the lamp is a high-pressure gas discharge lamp, and the electrode rod is embedded in a sealed portion of the envelope.

9. A lamp as claimed in claim 1, wherein the one or more recesses comprise one or more helical grooves or pits.

10. A lamp as claimed in claim 1, wherein the one or more recesses have a width A and a pitch B, the pitch B is greater than the width A to provide areas of the surface between recesses, the flexible dendritic protrusions are formed at the edges of the one or more recesses in the areas of the surface between the recesses.

11. A method of manufacturing a lamp, comprising:

rotating an electrode rod about its longitudinal axis; and directing one or more laser beam pulses onto at least a portion of a surface of the electrode rod during said rotating, by which material of the electrode rod is locally detached and forms one or more recesses in the portion of the surface of the electrode rod and flexible dendritic protrusions on the portion of the surface of the electrode rod at edges of the one or more recesses, the flexible dendritic protrusions forming a brush-like structure on the portion of the surface of the electrode rod, wherein an average material density of the brush-like structure is between 20% and 80% of a solid structure of the same material, thereby providing a mechanical flexibility and deformation potential that is substantially higher than that of the solid structure of the same material.

12. A method as claimed in claim 11, wherein said directing one or more laser beam pulses forms one or more helical recesses in the portion of the surface of the electrode rod.

13. A method as claimed in claim 12, wherein the one or more helical recesses comprise one or more helical grooves or pits.

14. A method as claimed in claim 11, further comprising applying a gas flow during said directing one or more laser beam pulses.

15. A method as claimed in claim 11, wherein the one or more recesses have a width A and a pitch B, the pitch B is greater than the width A to provide areas of the surface between recesses, the flexible dendritic protrusions are formed at the edges of the one or more recesses in the areas of the surface between the recesses.

* * * * *